United States Patent [19]

Lawson et al.

[11] 3,958,778

[45] May 25, 1976

[54] SELF LOCKING TEXTILE CORE

[75] Inventors: DeWayne L. Lawson, Mentor, Ky.; Raymond D. Roof, Cincinnati, Ohio

[73] Assignee: Olinkraft, Inc., West Monroe, La.

[22] Filed: May 21, 1975

[21] Appl. No.: 579,660

[52] U.S. Cl. ..... 242/222

[51] Int. Cl.[2] ..... B65H 75/06

[58] Field of Search ..... 242/222, 61, 50; 206/395, 396, 49

[56] References Cited

UNITED STATES PATENTS

| | | | |
|---|---|---|---|
| 2,061,101 | 11/1936 | Platt | 242/222 |
| 2,660,298 | 11/1953 | Field | 242/61 X |
| 3,268,069 | 8/1966 | Clark, Jr. | 242/222 |
| 3,343,665 | 9/1967 | Marino | 242/61 X |
| 3,780,855 | 12/1973 | McLeod et al. | 242/222 |

*Primary Examiner*—Leonard D. Christian
*Attorney, Agent, or Firm*—Norvell E. Von Behren; O'Brien & Marks

[57] ABSTRACT

A paperboard textile core has two self locking tabs at each end of the core to secure the core together.

5 Claims, 6 Drawing Figures

SELF LOCKING TEXTILE CORE

BACKGROUND OF THE INVENTION

1. Field of the Invention

The invention relates to cores or reels upon which bolts of cloth are wound, and particularly to cores made from corrugated paperboard or the like.

2. Description of the Prior Art

The prior art as exemplified in U.S. Pat. No. 2,660,298, U.S. Pat. No. 2,981,406, U.S. Pat. No. 3,268,069, U.S. Pat. No. 3,343,665 and U.S. Pat. No. 3,780,855, contains a number of cores formed from corrugated paperboard. The prior art corrugated paperboard cores are generally manufactured, folded and glued at the container manufacturing facility after which they are shipped in glued and assembled form to the textile manufacturer or user of the cores; this results in excessive costs in shipping fees and storage costs since assembled cores occupy a volume many times the volume occupied by cut and scored but unassembled blanks of paperboard cores, requiring greatly excessive transportation vehicle space and storage space for the assembled textile cores. Another disadvantage in the use of glued textile cores is that the cores can not be readily checked to see if the glue has been applied in the right place in sufficient quantity; for example if insufficient glue is provided for the majority of a longitudinal seam there is no easy method to see if the seam is sufficient and such a deficient seam is probable to open when subjected to stress in use. Another problem encountered is that excessive quantities of glue on the prior art textile cores can contaminate a portion of the textile material wrapped around the core.

Other types of prior art textile cores have been made from solid pieces of wood, polystyrene, and various other materials; such cores generally subject to one or more deficiencies such as being excessively costly or having insufficient strength to withstand normal use.

SUMMARY OF THE INVENTION

The invention is summarized in a textile core including an elongated first side panel, a pair of edge panels hinged on the opposite longitudinal side edges of the first side panel, a pair of elongated second side panels each hinged at one longitudinal edge thereon to the respective pair of edge panels opposite to the first side panel, a pair of rib panels hinged on the other longitudinal edges of the respective pair of elongated second side panels for being bent inward into face to face relationship, a pair of end panels hinged on the respective end edges of the first side panel, a pair of overlapping second side panels hinged on the respective end panels opposite the first side panel for overlapping respective end portions of the elongated second side panels, each of the pair of elongated second side panels having a pair of transverse slots formed therein and spaced from the respective ends thereof, and two pairs of tabs, each pair of tabs hinged on a respective one of the pair of the overlapping side panels for extending through respective ones of each of the pairs of slots to secure the panels in an assembled position.

An object of the invention is to construct a textile core which can be shipped to a customer in a disassembled state and then easily assembled prior to placing in service.

Another object of the invention is to eliminate the requirement for glue to secure seams of textile cores together.

It is also an object of the invention to avoid contamination and creasing of material wound on textile cores.

Still another object of the invention is to construct a textile core which is relatively inexpensive and has sufficient strength to withstand use in supporting bolts of cloth and the like.

Other objects, advantages and features of the invention will become apparent from the following description of the preferred embodiment when taken in conjunction with the accompanying drawings.

DESCRIPTION OF THE PREFERRED EMBODIMENT

Figure 1:
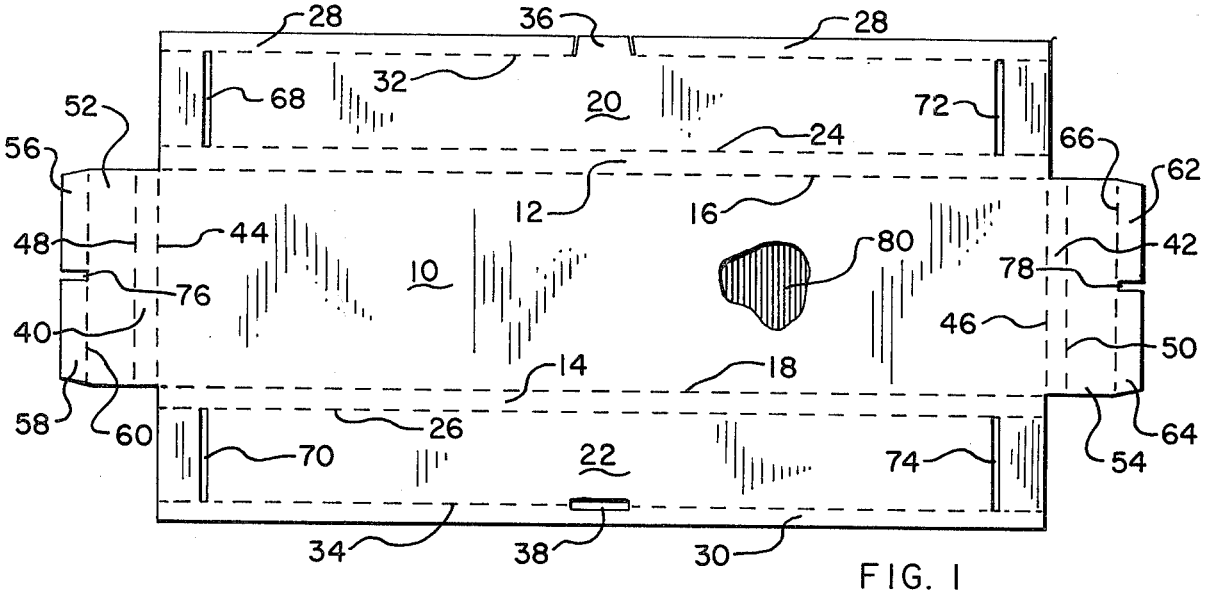
FIG. 1 is a plan view of a textile core in a disassembled state in accordance with the invention.
Figure 2:
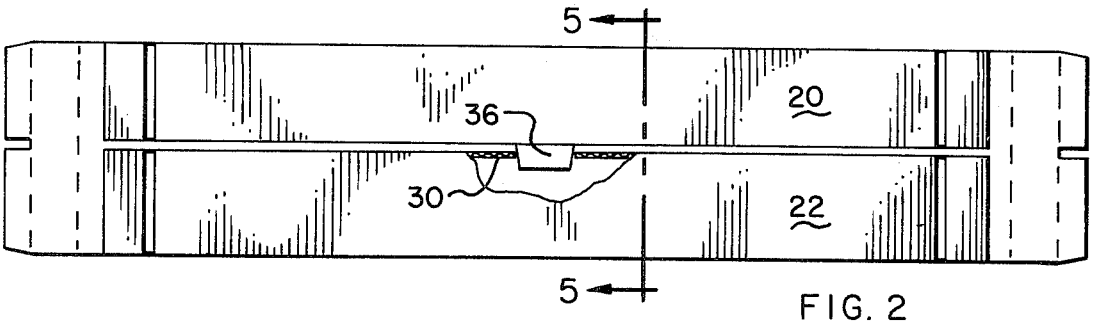
FIG. 2 is a top view of the textile core of FIG. 2 in a partially assembled state.

As illustrated in FIGS. 1–6 the invention is embodied in a textile core formed from an integral sheet of corrugated paperboard or the like. The textile core includes an elongated bottom side panel 10 with edge panels 12 and 14 hinged at score lines 16 and 18 on the respective longitudinal edges of the panel 10. A pair of top side panels 20 and 22 are hinged at score lines 24 and 26 to the upper edges of the edge panels 12 and 14 while rib or center reinforcement panels 28 and 30 are hinged at score lines 32 and 34 to the inside edges of the top panels 20 and 22. A center tab 36 is cut from the center portion of the rib panel 28 and is not scored by the score line 32 while a slot 38 is cut in the upper edge of the rib panel 30 centrally therein for receiving the center tab 36.

End panels 40 and 42 are hinged at respective score lines 44 and 46 to the ends of the bottom side panel 10 and have upper edges joined by score lines 48 and 50 to overlapping panels or flaps 52 and 54. Locking tabs 56 and 58 are hinged at a score line 60 on the inside edge of the overlapping panel 52 while locking tabs 62 and 64 are hinged at a score line 66 on an inside edge of the overlapping panel 54. Slots 68 and 70 are formed in the respective top panels 20 and 22 perpendicular to the longitudinal edges of the panels 20 and 22 and parallel to the overlapping panel 52. The slots 68 and 70 are spaced from the left end of the panels 20 and 22 by about the width of the overlapping panel 52 for receiving the locking tabs 56 and 58. Similarly slots 72 and 74 perpendicular to the longitudinal dimension of the core are formed in the top panels 20 and 22 spaced by about the width of the overlapping panel 54 from the right end of the panels 20 and 22 for receiving the locking tabs 62 and 64. The slots 68, 70, 72, and 74 extend substantially completely across the width of the respective panels 20 and 22. The locking tabs 56 and 58 each extend slightly less than half way across the length of the overlapping panel 52 and end panel 40 and have inner edges spaced apart at 76 by a distance slightly greater than twice the thickness of the paperboard. Similarly the locking tabs 62 and 64 each extend slightly less than one half the length of the overlapping panel 54 and the end panel 42 to form a space or slot at 78 between the inner edges of the tabs 62 and 64, which space is slightly greater than twice the thickness of the paperboard.

The fluting or corrugations 80 of the paperboard are oriented to run crosswise or substantially perpendicular to the longitudinal dimension of the bottom side panel 10 and the top panels 20 and 22. Preferrably the score lines 32 and 34 include a line of perforations to enable easy bending of the rib panels 28 and 30 on the score lines 32 and 34. Also the exposed die cut edges of the core are preferrably formed by a serrated cutting rule in the die to avoid lacerations by the paper edges engaging the hands of persons assembling the cores and to avoid creases in fabrics such as can be caused by straight cut edges. The outside ply of the paperboard is conveniently formed from a beached paper to avoid discoloring of cloth or the like wrapped thereon.

In assembly of the textile core, the rib panels 28 and 30 are first bent upward and then the top panels 20 and 22 and the edge panels 12 and 14 are folded upward and inward. The center tab 36 is inserted into the center slot 38 to secure the top panels 20 and 22 with the rib panels 28 and 30 in a face-to-face relationship extending downward along the center against the bottom side panel 10. Then the overlapping panels 52 and 54 and the end panels 40 and 42 are folded upward and over the open ends and the end portions of the top panels 20 and 22 with the locking tabs 56, 68, 62 and 64 being inserted in the respective slots 68, 70, 72 and 74 of the top panels 20 and 22.

Figure 3:
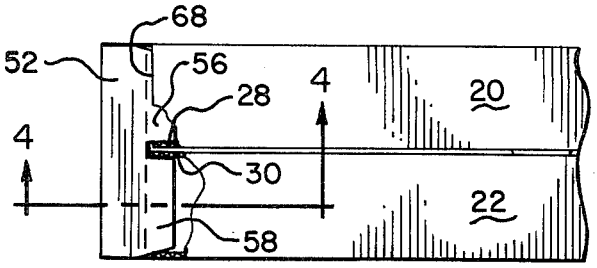
FIG. 3 is a top view of a broken away portion of the textile core of FIG. 1 in a fully assembled state.
Figure 4:
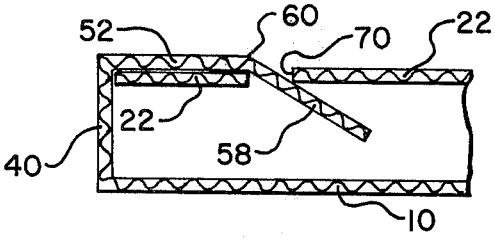
FIG. 4 is a cross section view taken along line 4—4 of FIG. 3.
Figure 6:
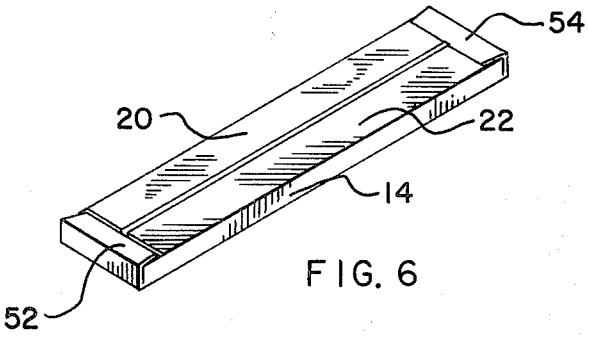
FIG. 6 is a perspective view of the textile core of FIG. 1 in a fully assembled state.
Figure 5:
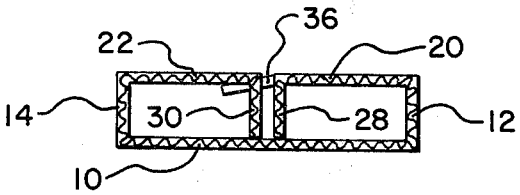
FIG. 5 is a cross section view taken along line 5—5 of FIG. 2.

As illustrated in FIG. 4 the locking tab 58 extends through the slot 70 and the resilience of the paperboard at the hinge on score line 60 tends to force the locking tab 58 upward thus securing the overlapping panel 52 against the end portion of the top panel 22 and securing the locking tab 58 in the slot 60. Similarly the other locking tabs 56, 62 and 64 secure the overlapping panels 52 and 54 against the end portion of the respective top panels 20 and 22 and secure the tabs 56, 62 and 64 within the respective slots 68, 72 and 74. As illustrated in FIG. 3, the adjacent inner edges of the locking tabs 56 and 58 extend over the rib panels 28 and 30 to hold the rib panels 28 and 30 in the vertical position substantially together. The outward resilience or tendency of the rib panels 28 and 30 to move apart causes a gripping force on the inner edges of the tabs 56 and 58 tending to hold the tabs within the slots 68 and 70.

When fabric is wound on the core the fabric engages the overlapping panels 52 and 54 further tending to maintain the core assembled and rigid.

Since many variations, modifications, and changes in detail may be made to the presently described embodiment it is intended that all matter in the foregoing description and shown in the accompanying drawings be interpreted as illustrative and not in a limiting sense.

What is claimed is:

1. A textile core comprising
an elongated bottom side panel,
a pair of edge panels hinged on the opposite longitudinal side edges of the bottom side panel,
a pair of elongated top side panels each hinged at one longitudinal edge thereon to the respective pair of edge panels opposite to the bottom side panel,
a pair of rib panels hinged on the other longitudinal edges of the respective pair of elongated top side panels for being bent inward into face to face relationship,
a pair of end panels hinged on the respective end edges of the bottom side panel,
a pair of overlapping panels hinged on the respective end panels opposite the bottom side panel for overlapping respective end portions of the elongated top side panels,
each of the pair of the elongated top side panels having a pair of transverse slots formed therein and spaced from the respective ends thereof, and
two pairs of tabs, each pair of tabs hinged on a respective one of the pair of the overlapping panels for extending through respective ones of each of the pairs of slots to secure the panels in an assembled position.

2. A textile core as claimed in claim 1 including a center tab cut centrally in the rib panel on one of the top side panels, and the other rib panel having a slot cut in the inside edge thereof for receiving the center tab.

3. A textile core as claimed in claim 1 wherein the locking tabs on each overlapping panel have adjacent inside edges thereof for engaging the rib panels to hold the rib panels together.

4. A textile core as claimed in claim 3 wherein
the slots formed in the pair of elongated top side panels extend perpendicular to the longitudinal edges of the elongated top side panels substantially completely thereacross, and
the pair of tabs on each overlapping panel are hinged on a single straight edge of each overlapping panel.

5. A textile core as claimed in claim 4 wherein the two pairs of tabs are resiliently hinged on the respective overlapping panels for holding the overlapping panels against the overlapped end portions of the elongated top side panels.

* * * * *